US006435508B1

(12) United States Patent
Tavel

(10) Patent No.: US 6,435,508 B1
(45) Date of Patent: Aug. 20, 2002

(54) COLLECTIBLE CARDS AND A GAME PLAYED THEREWITH

(75) Inventor: Phillip Alden Tavel, Seattle, WA (US)

(73) Assignee: Interactive Imagination, Seattle, WA (US)

( * ) Notice: Subject to any disclaimer, the term of this patent is extended or adjusted under 35 U.S.C. 154(b) by 0 days.

(21) Appl. No.: 09/696,084

(22) Filed: Oct. 26, 2000

(51) Int. Cl.[7] ..... A63F 1/00

(52) U.S. Cl. ..... 273/292; 273/244; 273/307; 273/308

(58) Field of Search ..... 273/292, 296, 273/308, 302, 272, 244, 245, 246

(56) References Cited

U.S. PATENT DOCUMENTS 5,071,136 A * 12/1991 Lott ..... 273/259
5,662,332 A * 9/1997 Garfield ..... 273/308
6,017,034 A * 1/2000 Hennessey ..... 273/296
6,142,475 A * 11/2000 Hennessey ..... 273/296

* cited by examiner

*Primary Examiner*—Benjamin H. Layno
*Assistant Examiner*—Dolores Collins
(74) *Attorney, Agent, or Firm*—George O. Saile; Stephen B. Ackerman

(57) ABSTRACT

Collectible cards and a multi-participant competitive turn-based game played therewith. The game characters are drawn from a story and certain properties of the game cards are activated by the participant in accordance with an algebraic equation, providing, thereby, a literary and mathematical learning experience.

12 Claims, 1 Drawing Sheet

COLLECTIBLE CARDS AND A GAME PLAYED THEREWITH

BACKGROUND OF THE INVENTION

1. Field of the Invention

This invention relates to collectible game cards and a game played therewith; more specifically to a multi-participant competitive turn-based card game having literary, reading comprehension, scientific and mathematical learning components.

2. Description of the Related Art

The prior art relating to playing cards and card games discloses a wide variety of games as well as the types of cards used to play them. A description of several such games is provided by Hennessey (U.S. Pat. No. 6,017,034). The most well known of these are the card games played using the so-called "standard" playing card deck of 52 cards, wherein the generic nature of the deck allows it to be used in the play of many different games, each having different rules and different definitions of "victory." Since the cards themselves have fairly limited and simple features, the complexity and inherent interest of each game played depends on the nature of its rules and the skills of the participants. More recently, a new genre of card game has appeared, the fantasy, adventure and role-playing type multi-participant card game. The game takes the form of a competition, wherein the card characters held by one of the participants and selected from that participants deck attempt to defeat the card characters held by the other participants that were selected from their respective decks using strategies and tactics in accord with the rules of the game. In general, the goal of each participant is to use the various powers of his cards to reduce the "energy" or "life force" of the other participants to a point where they must leave the game. In order to denote characters with particular qualities, powers and strengths, these games provide playing cards with a rich set of features and appearances, including among them symbolism and complex artistic renderings. As the game proceeds, the qualities and strengths possessed by the card characters of each player may be allowed to change as a result of other cards held by the player, the outcomes of various encounters with card characters held by other participants in the game and various other game circumstances. The qualities of a character generally define and circumscribe the actions that the character is permitted to take, while its strengths generally indicate the outcomes of encounters between that character and other characters. Also distinguishing such games from the standard card games is the fact that the deck is not fixed in terms of the number of card types it may contain. Players may be allowed to accumulate additional cards as a result of game victories, trading or purchase and these additional cards may be then be used in the play of the game to strengthen a players position or enlarge his playing options. The "collectible" aspect of the cards used in these games derives from the advantages that accrue to the participant who possesses them, as well as the intrinsic artistic merit of the cards and their rarity. An example of this type of game is provided by Garfield (U.S. Pat. No. 5,662,332). For the purposes of drawing a clear distinction between the cards and method of play provided by the present invention and the method of the game taught by Garfield, it should be pointed out that Garfield provides a game of great complexity, utilizing many different types of cards, whose purposes are further varied according to their colors and which are brought into play by a designation process of "tapping," in which the card is changed in its orientation. Further, in the game provided by Garfield, participants play simultaneously, rather than by taking a series of "turns," wherein each participant is allowed to actively play his hand while the other participants are temporarily inactive. In addition, in the game provided by Garfield, there is a special set of cards, "resource cards," that supply the energy needed to sustain the player. In the game provided by Garfield, it is the player himself who is provided with the energy, who is the object of attack by other players and who is defeated by being depleted of said energy, as opposed to a game in which it is the players cards that are supplied with energy and become the object of the competition. The game of Garfield does not use characters drawn from a story, nor does it provide a meaningful mathematical learning experience.

It is the purpose of the present invention to provide a game that goes beyond the attributes of others in the prior art and is thereby rendered more suitable for a wider range of participants, particularly younger participants. In particular, it is the purpose of the present invention to provide a game that not only differs from others in the prior art in terms of the nature and appearance of its cards, its rules, objectives, tactics, strategems, and general method of play, but also offers participants a multi-faceted learning and educational experience that is not provided by games known to the prior art.

SUMMARY OF THE INVENTION

The cards and card game provided by this invention not only offer their owner and game participant enjoyment at several different levels, but also a provide a significant educational and learning experience. Above and beyond their use in the play of the game, the cards of the present invention have an artistic quality that adds to their desirability and collectibility. Moreover, the game characters are so novel in their names, qualities and appearance that a strong bond is created between themselves and the participants, thereby enhancing the play of the game by fostering a strong interest in its progress. Unlike other card games of the prior art, such as the game of Garfield, cited above, the characters of the present invention are drawn from and a part of a written story that will, in one embodiment, accompany the game. This novel use of accompanying textual material encourages the participants to become involved in the game and to remain involved in it at a literary as well as competitive level. In the case of younger participants, the game reinforces the story and the participant is encouraged, thereby, to become an active reader as well as a game player. In a further effort to engage the younger player and provide that player with a multifaceted learning experience, the names of the card characters are chosen so as to start and end with every letter of the alphabet and to use every possible spelling convention and letter combination. In this way, merely voicing the names of the characters provides a language experience that is of particular value to the younger player. Another object of the present invention, again unlike the game of Garfield, is to provide a mathematical learning experience that results from algebraic and other numerical activities that must be undertaken by participants when utilizing certain of the cards. As will be seen in the Description of the Preferred Embodiment, certain of the cards can only be activated and used by the participant if a simple algebraic equation for the requisite energy is first solved. Finally, the actions of the characters, in both the game and the accompanying story, will adhere to scientific principles and terminology, even though the characters themselves may be drawn from fantasy. Unlike other games of the prior art, the player of the game provided by the present invention will be enriched in mathematical literacy, scientific literacy, language skills and reading comprehension. Again, unlike the game provided by Garfield, the present game is turn based, rather than played simultaneously by all participants. This feature provides more structure to the game, which is a feature particularly appreciated by the younger player. In addition, victory in the present game requires that energy be depleted from certain of the player's cards, rather than from the player himself. Although perhaps seeming to be a subtle point, for the younger participant the game seems less directed at his persona and is, therefore, less threatening. Additionally, the present game differs from that provided by Garfield by being less complex in terms of having fewer card types and requiring fewer activities such as "tapping" the cards and providing energy from external sources such as the resource cards. Thus the present invention provides a game that is sufficiently complex to engage the older participant, while being structured, less threatening and, thereby, more appealing to the younger participant.

Accordingly, it is a first object of this invention to provide a set of game cards and a simple, yet intellectually engaging turn-based game to be played therewith. It is a second object of this invention to provide a set of game cards which, by their appearance and mode of use in the game, are rendered desirable and, thereby, tradable and collectible. It is yet a third object of the present invention to provide a set of game cards and a game to be played therewith that afford the participants the enjoyment of competitive play together with a literary, scientific and mathematical learning experience. It is yet a fourth object of the present invention to provide a turn based game in which the victorious participant will have depleted the energy of certain cards held by his opponents.

BRIEF DESCRIPTION OF THE DRAWINGS

FIG. 1 is a Magi card. FIG. 2 is a Creature card. FIG. 3 is a Relic card. FIG. 4 is a Spell card.

DESCRIPTION OF THE PREFERRED EMBODIMENT

Referring to FIGS. 1–4, there are shown the four types of cards that the participant will use in the play of the game. The Magi card in FIG. 1, identified by the oval border (1) surrounding the artistic rendering of the particular Magi (2), is the centerpiece of the deck and the focus of the game. The goal of each participant is to defeat the Magi of your opponents, even as they try to defeat your Magi. The Magi can bring Creatures into play, cast Spells and use special Powers, in accordance with the instructions printed in a "text box" (3) on the face of the card. The initial strength of the Magi is determined by its starting Energy number (5). As the game continues, the Magi is re-energized at the start of each turn with an amount of energy indicated in the text box as "energize" (6). The text box also indicates, after the word "starting" (7), the set of Creature cards and Spell cards the Magi is entitled to begin play with. Finally, the text box also contains a list of the magical powers of the Magi (8). Finally, as an aid to determine the collectibility of each card, a series of dots (9) in the lower right-hand corner determines the rarity of the card in terms of the number produced. One dot is rare, two is uncommon and three is common.

Figure 1:
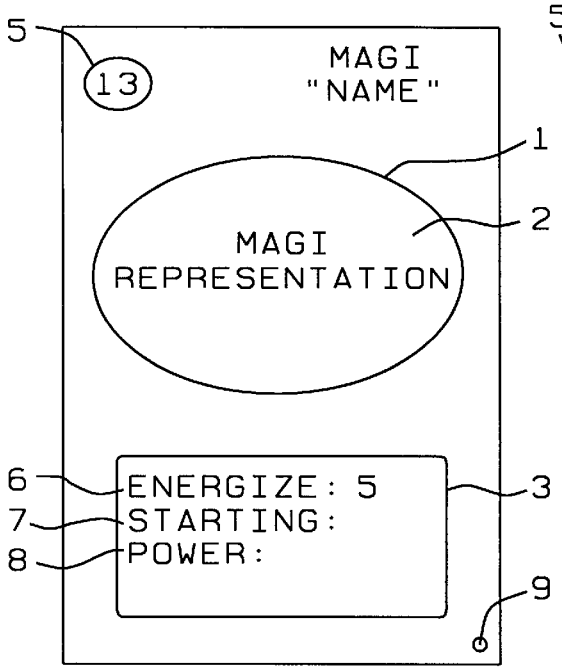
FIGS. 1 through 4 are depictions of the four types of cards that are used in a preferred embodiment of the present game.
Figure 2:
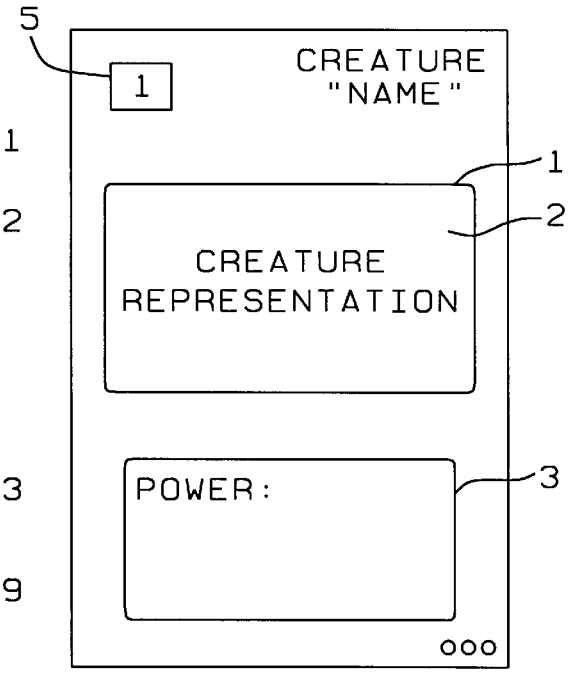

Referring to FIG. 2, there is shown a Creature card, which can be identified by the rectangular border (1) surrounding the artistic rendering of the particular creature (2). Creatures have specific powers, which are printed in a text box (3) on the face of the card. Creatures are called into play by Magi, through the participant, in accord with the rules of the game, wherein an amount of energy equal to the starting energy of the creature (5) must be transferred from the Magi's store of energy to the Creature. In accord with the themes of the story from which the game characters are drawn, Creatures are from the "Dream Realm" and are called forth by Magi to do battle with other Magi. The Creatures have powers to help you defeat your opponent.

Figure 3:
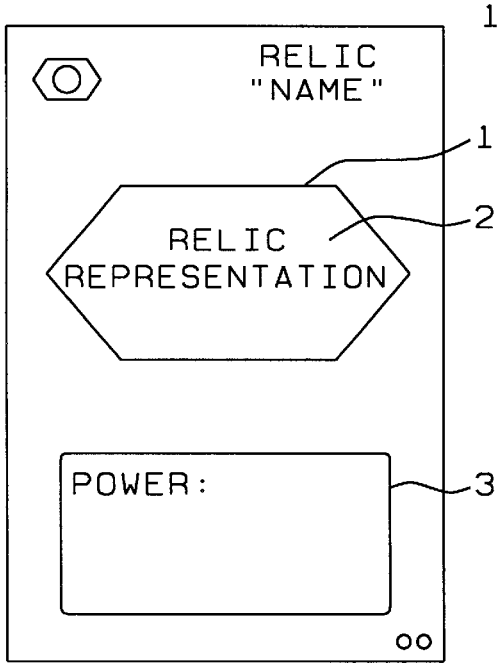

Referring now to FIG. 3, there is shown a Relic card, which can be identified by the hexagonal border (1) surrounding the artistic rendering of the particular Relic (2). Relics are objects used by Magi to augment and vary their powers in accord with the instructions printed on the face of each relic card (6).

Figure 4:
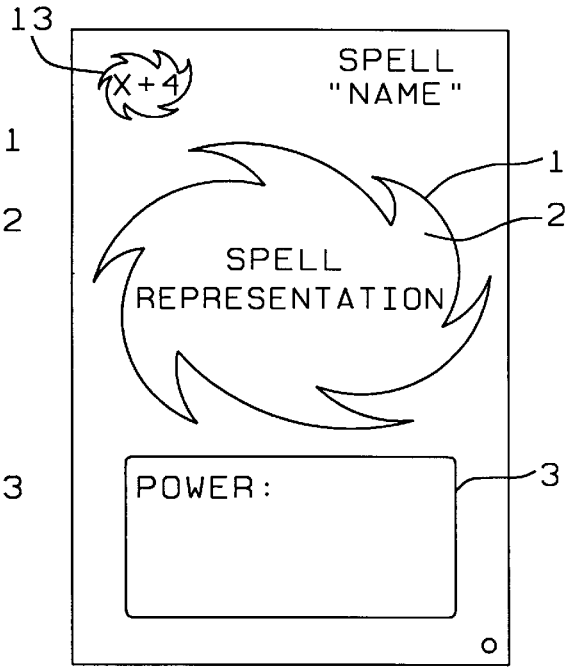

Referring finally to FIG. 4, there is shown a Spell card, identified by the whirlwind shaped border (1) surrounding the artistic rendering of the spell (2). Spells are one-time use cards that represent an action being taken by a Magi. Spells can accomplish many feats, from the addition of energy to Creatures, to discarding the Creatures of an opponent, in accordance with the printed description on the face of the card (3). Certain Spells are particularly novel in that they use an algebraic variable to determine their effect. The Spell card depicted in this figure depletes the energy of an opponent's card by the amount "x+4" (10). The Spell card is discarded after being used.

The object of the game is to remove all of the energy possessed by your opponent's characters. This entails the discarding of all your opponent's Creatures and removing all of the energy possessed by their Magi. The manner in which this is attempted and ultimately accomplished will be described in the context of the following series of steps. The steps are written under the assumption that there are two game participants, but the extension to a multi-participant game is straightforward.

Step 1. Selecting Magi.

Select three Magi from your deck and place them face down in front of you so that you do not know which Magi is in which position. Your opponent follows suit. Each player then chooses the other player's starting Magi. Place that Magi place down in front of you, moving the two other Magi over to the side in what is designated the "Magi pile." As the game progresses, defeated Magi will be turned face up and placed at the bottom of the Magi pile.

Step 2. Choosing Order of Play.

Each player rolls a six-sided die. The higher roll chooses the first to play.

Step 3. Beginning Play.

The first to play turns their Magi face up. The starting energy number of the Magi is indicated on the upper left-hand comer of the card face (FIG. 1, (12)). A set of energy tokens, whose total amount of energy equals the Magi's starting energy, is placed on the Magi card. Thus, a starting energy of 12 could be represented by two 5-unit tokens and one 2-unit token.

Step 4. Selecting the Starting Hand.

The text box of your Magi lists a group of cards with which you construct your hand. Your hand must contain a total of five cards, the ones listed in your Magi's text box, plus any others chosen at random to bring the number to five. If your deck does not contain all the cards listed on your Magi, choose any others you wish to replace them.

Step 5. Energize.

Your Magi's text box also contains an "energize" number. This number represents the amount of additional energy units you can add to your Magi at the beginning of every turn subsequent to the starting turn.

Step 6. Powers/Relics/Spells.

At this point in your turn, you can play your Relics, cast your Spells, or use your Powers. This can be done in any order. When you have finished, proceed to the next step. Powers, Relics and Spells are used as follows.

Powers: If a Magi, Relic or Creature card has the word "Power" in its text box, that Power can be used during this phase of the play. Each Power can be used only once during a turn and its use has an energy cost. If the Power of a Creature is used, the energy for that Power must then be removed from the Creature. If the Power of a Magi or Relic is used, the energy for that power must be removed from the Magi.

Relics: If you play a Relic, there is an energy cost that appears in the upper left-hand corner of the card. Most Relics have a zero energy cost to bring them into play.

Spells: If you cast a Spell, look in the card's upper left-hand comer for the associated energy cost. Next, remove that amount of energy from your Magi and discard it. Then, show the Spell to your opponent, do whatever the Spell says to do and discard the Spell. Some Spells instruct you to leave the card in play for a given number of turns.

Effects: Some of the cards also have "Effects" indicated in their text box. An effect is always active.

Step 7. Attack.

This step of the play occurs only after the first turn, because no Creatures are in play at the first turn. Each of your Creatures can attack once in each turn, unless a Spell, the text box of your Creature or your Magi allows the Creature to attack more than once. Select one of your Creatures to be the attacker and one of your opponent's Creatures to be the defender. Next, remove from your opponent's Creature the number of energy tokens that are on your Creature. At the same time, remove from your Creature, the number of energy tokens that were on your opponent's Creature. The Creature with the lesser amount of energy is thereby removed from the game by virtue of losing all of its energy. The Creature with the initially greater amount of energy is now depleted by virtue of the encounter. You can attack only once with each of your Creatures, but you can attack the same defending Creature more than once by using multiple attackers. If your opponent has no Creatures remaining, you can attack their Magi directly. When a Creature attacks a Magi, the Magi loses the number of energy tokens possessed by the Creature, but the Creature does not lose any energy when attacking a Magi. When a Creature has no remaining energy, it is immediately discarded.

Step 8. Bring in New Creatures.

After you have finished attacking, you may bring new Creatures into play from your hand. This requires that you transfer an amount of energy equal to the Creature's starting energy from your Magi to the Creature. The Creature is thereupon placed face upward in front of you and the requisite amount of energy is transferred. In this manner, you may bring into play as many Creatures as you have energy for. Once you bring new Creatures into play in this manner, your attack phase is over and these Creatures cannot attack until your next turn. If, however, you use a Spell or Power to bring a Creature into play, that Creature may attack during the same turn unless there is some negative indication to that effect.

Step 9. Powers/Relics/Spells.

This step is the same as Step 6, except that at this point it gives you a chance to use the Powers of your new Creatures, although you cannot attack with them.

Step 10. Draw Your Cards.

Draw two cards. Your turn is now over and it is your opponent's turn to play. At your next turn and in all subsequent turns, steps 5 through 10 are repeated.

Step 11. Proceed to the End of the Game.

As steps 5 through 10 are repeated, players will from time to time have all the tokens on their upturned Magi card removed. At this point, that Magi card is discarded along with all his Relic cards in the players hand and a remaining Magi card is upturned and provided with starting energy. When all of a players Magi cards have been discarded, that player has been defeated. The player who remains is the winner of the game.

Certain cards use an algebraic variable "x" as part of their effect on other cards. An example is the Spell card of FIG. 4, in which x represents a variable amount of energy that can be removed from an opponent's Creature card. This means that x must be set to that amount of energy necessary to defeat a Creature, as long as that amount is consistent with the player's available energy. Suppose, for example, you wish to remove 3 energy units from an opponent's Creature. Your Spell requires x+4 units of energy to accomplish this task. Thus, x=3 and your Spell, therefore, requires 7 energy units. Although the algebraic reasoning is simple, the player is made constantly aware of the variability of a task and the means of representing such variability in an equation. It is well known that beginning students of algebra have a difficulty in thinking in terms of letters as variables that take on numerical values. One of the objects of this game is to incorporate such thinking directly within the context of the play.

As is understood by a person skilled in the art, the preferred embodiment and examples of the present invention are illustrative of the present invention rather than limiting of it. Revisions and modifications may be made to stories, characters, cards, and rules of play that define the collectible cards and game played therewith of the present invention while still providing such collectible cards and game played therewith in accord with the present invention and appended claims.

What is claimed is:

1. A method for playing a multi-participant, competitive, turn-based game for two or more players using collectible game cards comprising:

providing each player a plurality of game tokens and a deck of game cards comprising pluralities of collectible cards of al least four different types, wherein each type of card has specific strengths, powers, effects, purposes and objects written on the face of said card and defined within the rules of the game and wherein the play of the game proceeds according to a series of steps taken by each player, there being first an initial sequence of steps designated as the starting sequence taken by each such player and further comprising;

selecting from his deck a certain number of cards of a first type, further selecting one of said cards to be placed face up, placing the remainder of said cards, face down, off to the side, and;

rolling a six-sided die to determine the order of play; and placing, by the player selected to play first, a certain initial number of game tokens on the card selected by said player to be face up, said number of tokens corresponding to a number appearing on the face of said first-type card and applied only on the first turn, and;

selecting by said player from his deck a group of cards consisting of members of those cards of a second type, a third type and a fourth type, that are in his possession and specified by instructions written on the face of the first type card that now lies face up, and;

selecting randomly by said player from the remainder of his deck an additional number of cards of the second type, third type and fourth type such that the total number of selected cards now amounts to the specific number determined by the rules of the game to comprise the starting hand, and;

placing by said player an additional number of game tokens on the face up card, also in accord with a number on the face of said card, said number of tokens to be added at the beginning of each round of play, and;

using, by said player, in accordance with the strategems, tactics and skills acquired in the play of the game, the powers and strengths specified on the faces of those cards of the third and fourth type in his possession, and;

replicating, by each additional player, in clockwise order, the preceding initial steps of the first player, following which replication the game proceeds by a repetition of the following activities of each player, in an order from first player to the other players in clockwise fashion, said activities further comprising;

attempting to reduce to zero the number of tokens on the upturned card of the first type held by an opponent or opponents by activating chosen cards of the second, third and fourth type in said player's hand and applying the powers, effects and strengths of said activated cards to the benefit of his own cards and to the detriment of his opponents cards and;

activating, immediately thereafter said attempt, such additional cards of the second type presently in his hand but not yet activated, and;

using the powers and strengths specified on the faces of those cards of the third and fourth type in his possession, and;

drawing two additional game cards; and discarding, at this or any other time during play of the game, his upturned card of the first type when the number of tokens on that card is reduced to zero and, thereupon, also discarding from his hand all of his type three cards and turning face up one of his remaining cards of the first type, and, if all his cards of the first type have been discarded, leaving the game; and, if all but one player has left the game, declaring as winner the sole remaining player possessing one or more cards of the first type.

2. The method of claim 1 wherein three cards of the first type are drawn.

3. The method of claim 1 wherein the starting hand comprises a total of five cards.

4. The method of claim 1 wherein the activation of cards of the second, third and fourth type is accomplished by transferring tokens from the card of the first type to said cards of the second, third and fourth types.

5. The method of claim 1 wherein certain cards of the second, third and fourth types are activated according to an algebraic formula printed on said cards.

6. The method of claim 1 wherein the characters specified on the faces of the cards of the first, second, third and fourth types are characters in a story that accompanies the game.

7. The method of claim 1 wherein the cards of the first type are Magi cards, the cards of the second type are Creature cards, the cards of the third type are Relic cards and the cards of the fourth type are Spell cards.

8. The method of claim 7 wherein the character names of Magi cards and Creature cards are drawn from a set whose first and last letters separately and independently include all of the letters of the English alphabet.

9. The method of claim 7 wherein the character names of Magi cards and Creature cards are drawn from a set that separately and independently make use of all the spelling conventions of the English language.

10. The method of claim 7 wherein the game tokens represent units of energy that are supplied to the game cards.

11. The method of claim 1 wherein the size of the players deck is determined by the number of cards that he has collected, either through game victories, trades or purchases.

12. The method of claim 7 wherein each card has an intrinsic rarity specified by a number of dots on the face of the card, one dot being rare, two dots being uncommon and one dot being common.

* * * * *